US008475071B2

(12) United States Patent
Yamanaka

(10) Patent No.: US 8,475,071 B2
(45) Date of Patent: Jul. 2, 2013

(54) CONICAL NIB AND WRITING INSTRUMENT INCORPORATING THE SAME

(76) Inventor: Shizuo Yamanaka, Mitaka (JP)

( * ) Notice: Subject to any disclaimer, the term of this patent is extended or adjusted under 35 U.S.C. 154(b) by 671 days.

(21) Appl. No.: 12/776,033

(22) Filed: May 7, 2010

(65) Prior Publication Data

US 2011/0274478 A1 Nov. 10, 2011

(51) Int. Cl.
*B43K 5/00* (2006.01)
*B43K 17/02* (2006.01)

(52) U.S. Cl.
USPC ..... 401/235; 401/221; 401/224; 401/231; 401/292

(58) Field of Classification Search
USPC ..... 401/221, 224, 231, 235, 265, 292
See application file for complete search history.

(56) References Cited

U.S. PATENT DOCUMENTS 2,431,015 A * 11/1947 Andrews et al. ..... 401/292
3,518,019 A * 6/1970 Nakamura ..... 401/265
3,520,629 A * 7/1970 Otsuka ..... 401/199
3,614,248 A * 10/1971 Otsuka ..... 401/292
3,945,735 A * 3/1976 Nakashiki et al. ..... 401/216
3,947,137 A * 3/1976 Hori ..... 401/217
3,969,027 A * 7/1976 Randar et al. ..... 401/199
4,208,145 A * 6/1980 Azuma ..... 401/196
4,531,853 A * 7/1985 Hirabayashi et al. ..... 401/265
4,547,947 A * 10/1985 Oshita ..... 401/261
5,015,113 A * 5/1991 Yamanaka ..... 401/224
5,902,064 A * 5/1999 Yamanaka ..... 401/292
5,957,610 A * 9/1999 Yamanaka ..... 401/221
6,652,177 B2 * 11/2003 Shimada et al. ..... 401/233
2003/0152415 A1 * 8/2003 Shimada et al. ..... 401/233
2012/0057924 A1 * 3/2012 Yamanaka ..... 401/222

* cited by examiner

*Primary Examiner* — David Walczak
*Assistant Examiner* — Bradley Oliver
(74) *Attorney, Agent, or Firm* — Browdy and Neimark, PLLC

(57) ABSTRACT

A nib of a writing instrument is made of a carbon-resin mixture obtained by mixing a plastic material with carbon fiber. An ink feed core is provided with a nib cover. The nib cover is disposed on an outer periphery of the ink feed core between the nib and the ink feed core. The nib cover is configured to closely adhere at least to an inner periphery of the nib at the tip of the nib. A space defined between the nib and the ink feed core is filled up with the nib cover. The nib is made of a carbon-resin mixture obtained by mixing a plastic material with carbon fiber. With this configuration, a nib having high wear resistance can be obtained and duration of the nib and the writing instrument can be prolonged.

5 Claims, 19 Drawing Sheets

CONICAL NIB AND WRITING INSTRUMENT INCORPORATING THE SAME

BACKGROUND OF THE INVENTION

1. Field of the Invention

The present invention relates to a conical nib and a writing instrument incorporating the same. More particularly, the invention relates to a conical nib having high wear resistance and a writing instrument incorporating the same.

2. Description of the Related Art

A writing instrument including this kind of conical nib is disclosed in Japanese Unexamined Patent Application, First Publication No. H9-156279. A nib of the disclosed writing instrument includes a nib base body and a converging member. The nib base body includes a cylindrical base portion and five to eight combtooth pieces. The combtooth pieces protrude from an end of the base portion in a continuous manner. Each of the combtooth pieces has a circular-arc cross section. The combtooth pieces have slit-like grooves formed between adjacent combtooth pieces at a constant interval along a circumference of an axial center of the base portion. A hemisphere-divided portion is defined at a tip of each combtooth piece. The converging member is a metal pipe configured to fit onto an outer periphery of the nib base body. When the converging member is fit onto the nib base body, the combtooth pieces are made to gradually converge toward the tips thereof to forma conical shape. A hemispherical writing tip is defined at the tips of the combtooth pieces and ink feed paths are defined between adjacent combtooth pieces.

An ink feed core which has a capillary action reaching a tip thereof is inserted in a hollow space in the nib (i.e., the pen nib base body). The ink feed core is secured integrally to a tip of the pen shaft. The ink feed core is connected to an ink reservoir inside the pen shaft. The thus-configured nib can be used to write in many directions on a paper sheet. The nib can be used to write at any positions and at any angles, even when rotated about the pen shaft. Characters of varying width can be written in accordance with varying writing pressure. Recently, in order to meet demands on mass production and improvement in formability, the combtooth pieces are often formed of an injection-molded plastic material.

Writing instruments incorporating such plastic conical nibs, however, have poor wear resistance at the nibs and the nibs are easy to wear as compared with metal nibs or ceramic nibs.

The invention is made to solve these related art problems. An object of the invention is therefore to provide a plastic conical nib having high wear resistance and a writing instrument incorporating the same.

SUMMARY OF THE INVENTION

According to one aspect of the invention, there is provided a nib that is secured to a tip of a pen shaft containing an ink reservoir and is connected to the ink reservoir via an ink feed core having capillary action, the nib including: a cylindrical holder member; and a plurality of combtooth pieces provided at an end of the holder member, each of the combtooth pieces having a substantially hemispherical tip, the combtooth pieces being configured to gradually converge toward the tips thereof to form a substantially conical shape and the nib being formed in a conical shape including a writing tip at a tip thereof and ink feed paths defined between adjacent combtooth pieces, wherein the nib is made of a carbon-resin mixture obtained by mixing a plastic material with carbon fiber.

A mixing ratio of the plastic material to the carbon fiber in the carbon-resin mixture used for the nib is preferably 95 to 70% by weight to 5 to 50% by weight. An inner surface of the nib is preferably roughened.

As described above, since the nib is made of a carbon-resin mixture obtained by mixing a plastic material with carbon fiber, the writing instrument according to an aspect of the invention has advantageous effects that the nib has high wear resistance and that the duration of the nib and the writing instrument can be prolonged.

DESCRIPTION OF THE PREFERRED EMBODIMENTS

Embodiment 1

Figure 1:
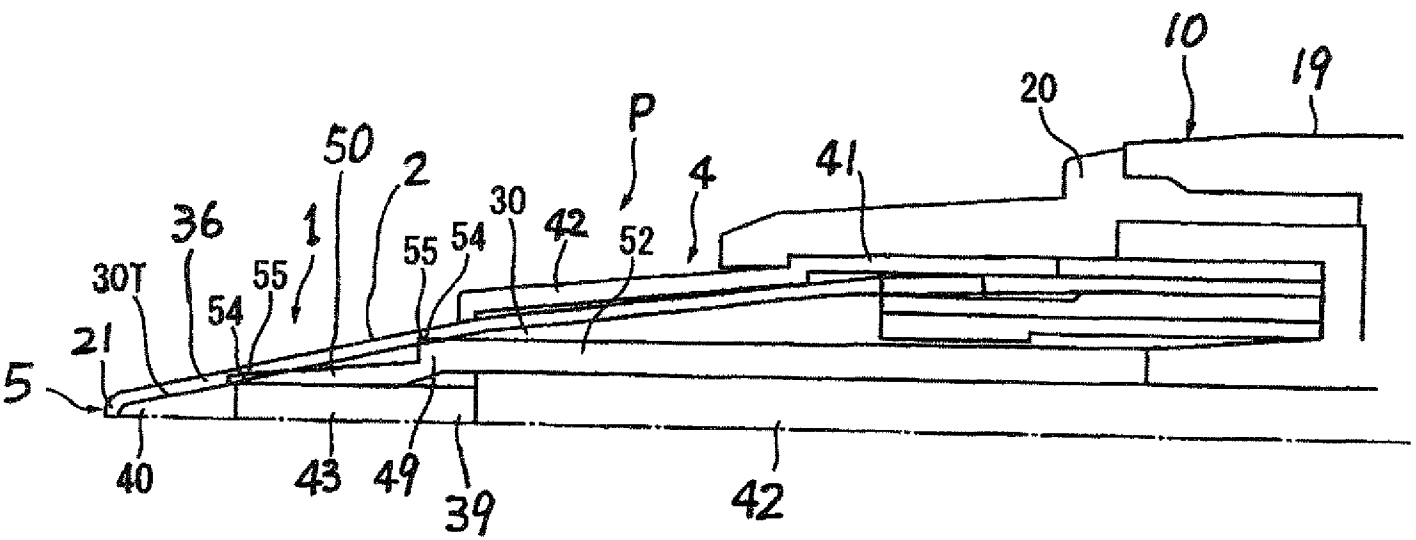
FIG. 1 is a partially cut-away enlarged sectional view of a main part of a writing instrument according to a first embodiment of the invention.

Hereinafter, a first embodiment of the invention will be described with reference to FIG. 1, and FIG. 2 to FIG. 4 as needed. FIG. 1 illustrates a main part of a writing instrument. As illustrated in FIG. 1, a writing instrument P includes a pen shaft 10 and a conical nib 1. The nib 1 is connected to ink contained in the pen shaft 10 through an ink feed core 39 which has a capillary action.

The pen shaft 10 includes a shaft cylinder 19 and an ink reservoir (not illustrated) integrally formed inside the shaft cylinder 19. The shaft cylinder 19 is formed of a plastic material into a tubular, e.g., cylindrical shape. A mouth piece (i.e., a tubular (cylindrical) mouth which fixes the nib 1) 20 is mounted at a front end of the shaft cylinder 19. A rear end of the mouth piece 20 is closed. The nib 1 is inserted in and secured to the mouthpiece 20 at the front end of the shaft cylinder 19. The ink feed core 39 is inserted in and disposed at an inside of the front end of the shaft cylinder 19. Accordingly, the ink reservoir is disposed at a predetermined area at a rear side of the pen shaft 10. The ink reservoir is refilled with ink directly. Alternatively, the ink is temporally held by, for example, an ink holding member, such as a synthetic fiber convergence body, and then supplied to the ink reservoir. A cap (not illustrated) is mounted at the front end of the shaft cylinder 19 from above the nib 1. The cap is made of a plastic material and has an opening at a rear end thereof. The cap is formed in a tubular, e.g., cylindrical, shape and a front end thereof is closed. A tubular sealing member which airtightly surrounds the nib is integrally provided inside a tubular shaped section. Accordingly, the cap has a double tubular structure.

Figure 2:
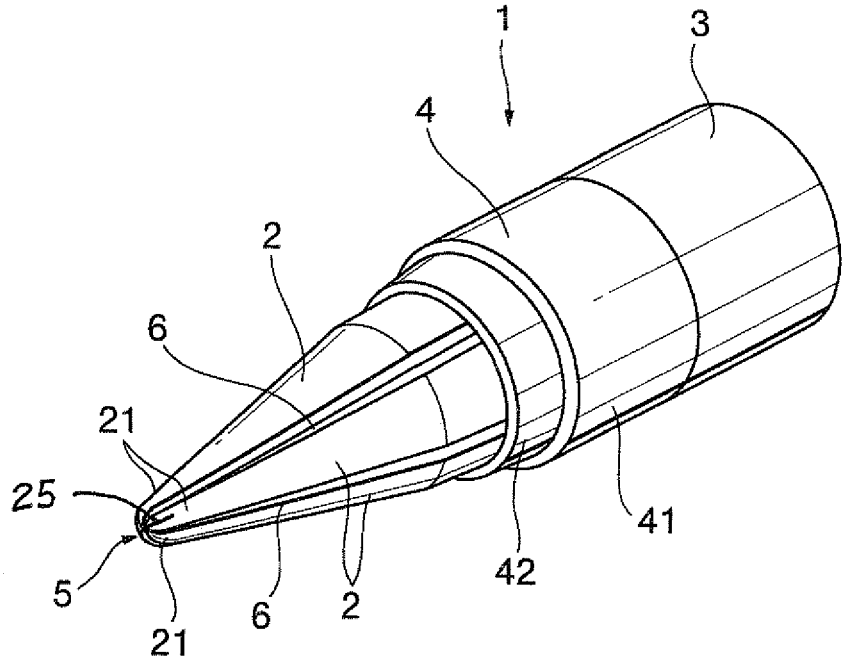
FIG. 2 is an enlarged perspective view of a nib according to the first embodiment incorporated in the writing instrument.

As illustrated in FIG. 2, the nib 1 includes plural combtooth pieces 2, a holder member 3, and a converging member 4. The combtooth pieces 2 are assembled together by the holder member 3 and the converging member 4. In the present embodiment, the combtooth pieces 2 are made of a carbon-resin mixture obtained by mixing a plastic (i.e., resin) material as a base material with carbon fiber. Each of the combtooth pieces 2 is formed separately and thus has an independent structure. The holder member 3 is formed separately from the combtooth pieces 2 and is made of a plastic material, a metallic material or a combination thereof. The entire holder member 3 is formed in a cylindrical shape. The converging member 4 is made of a metallic material, a resin material or a combination thereof. It should be noted that the holder member 3 and the converging member 4 may also be made of the carbon-resin mixture described above. As described above, in the present embodiment, the combtooth pieces 2 are made of the carbon-resin mixture, but there is less severe limitation on materials of the holder member 3 and the converging member 4 as compared with that of the combtooth piece 2.

The nib 1 made of the carbon-resin mixture is formed by injection molding. The carbon-resin mixture is obtained by mixing carbon fiber into a plastic material at a predetermined ratio. For example, the plastic material and the carbon fiber are mixed together at a ratio of 70:30% by weight. The plastic material and the carbon fiber are mixed together in order to increase hardness of the tips of the combtooth pieces 2 and to increase wear resistance. The combtooth pieces 2 made of the carbon-resin mixture have wear resistance during writing on a paper sheet significantly higher than that of related art combtooth pieces made merely of an ordinary plastic material. In some cases, the combtooth pieces 2 made of the carbon-resin mixture have wear resistance equivalent to or greater than those of related art nibs of ordinary writing instruments. Such related art nibs are made of a metallic material with iridium added thereto or made of a ceramic material. The term "ordinary plastic material" herein indicates a plastic material as opposed to a carbon-resin mixture. The ordinary plastic material has an injection molding temperature of 100 to 150° C. and is used for producing ordinary resin mold products. Examples of these plastic materials include vinyl chloride and ebonite. Polyacetal is often used as a nib from the viewpoint of its relatively high wear resistance among other plastic materials. Since the carbon-resin mixture used in the invention also has a characteristic of a plastic material, formability in producing the combtooth pieces 2 of the carbon-resin mixture is significantly high. The carbon-resin mixture is easily processed in molding, such as injection molding, or cutting. In this regard, the invention significantly differs from related art metallic or ceramic nibs that are difficult in processing during producing and are difficult in increasing precision and yield.

The plastic material used for the carbon-resin mixture adapted to the invention is resistive to high temperature. This is because it is necessary to melt the plastic material at high temperature of 200° C. to 350° C. and to add carbon so that resin is appropriately mixed with carbon. Examples of the plastic materials resistive to high temperature include polyphenylene sulfide (PPS), polyether ether ketone (PEEK), polyimide or other similar plastic materials. These plastic materials are thermoplastic high heat resistance polymer resin and are suitable for producing the carbon-resin mixture for the nib of an embodiment of the invention. A mixing ratio of the plastic material as the base material and the carbon fiber of the carbon-resin mixture used for the nib 1 of an embodiment of the invention may be 95 to 50% by weight: 5 to 50% by weight. There is no particular disadvantage if the carbon fiber is mixed at a ratio greater than 50% by weight. From the viewpoint of the cost of the carbon fiber, however, there is no additional advantageous effect in increasing the mixing ratio of the carbon fiber. It should be noted that components other than the nib 1, such as the pen shaft 10, may also be made of the carbon-resin mixture described above.

In order to increase holdability of the ink to be fed to the paper sheet, the combtooth pieces 2 made of carbon-resin mixture is surface-treated (i.e., roughened) or processed to provide a rough surface. The surface is roughened by, for example, sandblasting the surfaces of the injection-molded combtooth pieces 2. Alternatively, an inner surface of an injection mold is roughened in advance, which is used for injection molding of the combtooth pieces 2. The surfaces of the combtooth pieces 2 may be roughened by a chemical reaction with chemical substances, such as medicines. Exemplary processes for chemical roughing include blasting fluorine gas or chlorine gas onto the surfaces of the injection-molded combtooth pieces 2. The surfaces of the combtooth pieces 2 to be roughened correspond to back surfaces, i.e., inner surfaces, of the combtooth pieces 2 when assembled as a writing instrument. Other surfaces of the combtooth pieces 2 may also be roughened. A degree of roughening of the surfaces of the combtooth pieces 2 is determined such that, when the writing instrument is used for writing, the ink reached at the tip of the nib 1 from the ink reservoir is kept at the surfaces of the combtooth pieces 2 and is not allowed to drop on the paper sheet.

Each of the combtooth pieces 2 has a substantially hemispherical tip. The combtooth pieces 2 are configured to gradually converge toward the tips thereof to form a substantially conical shape. Each of the combtooth pieces 2 is formed in a substantially sword-like shape having an arc-shaped cross-section. A hemisphere-divided portion 21 of predetermined dimension is formed at the tip of each combtooth piece 2. A single or two or more slits 25 may preferably be formed at the tip of each combtooth piece 2 extending from the tip toward a base end (along the axial direction of the nib 1). The slit (s) 25 of predetermined length is formed linearly from the tip of the combtooth piece 2 extending within (or out of) a range of the writing tip 5. The base end of each combtooth piece 2 is fixed to the holder member 3. The base end includes a flange section and an increased diameter section having a diameter larger than that of the tip. A jig abuts a front end of the flange section to push the base end into the holder member 3. The front end of the flange section serves as a force point which receives the pushing force. A rear end of the flange section abuts a front end of a fixing section of the holder member 3 to fix the flange section to the position. By setting the distance between the rear end of the flange section and the tip of the combtooth piece 2 to be constant, when a necessary number of combtooth pieces 2 are inserted along the circumference of the holder member 3, the tips of the combtooth pieces 2 can be aligned with one another to conform the shape of the conical nib. With this configuration, the writing tip 5 is formed to be hemispherical as much as possible even if separately formed combtooth pieces 2 are assembled together to be aligned with one another and the entire nib tip can be made to gradually converge to be conical as much as possible. The number of the combtooth pieces 2 is preferably three to eight.

As described above, the holder member 3 is provided separately from the combtooth pieces 2 and is made of a plastic material, a metallic material or a combination thereof in a cylindrical shape as a whole. Groove-shaped fixing sections are provided at an end surface of the holder member 3. A to-be-fixed portion of the base end of each combtooth piece 2 can be inserted along an axial direction of the holder member 3. The base ends of the combtooth pieces 2 are inserted in the fixing sections of the holder member 3 so that the combtooth pieces 2 can be arranged along the circumference (of the end surface of the holder member 3).

As described above, the converging member 4 also is made of a metallic material, a resin material or a combination thereof. The converging member 4 includes a substantially cylindrical column-shaped converging section 41 and a conical trapezoidal narrowing section 42. The converging section 41 is formed in a cylindrical shape to be fit onto an outer periphery of the combtooth pieces 2 arranged along the circumference by the holder member 3. The converging section 41 has an outer diameter equivalent to that of the holder member 3, and an inner diameter that can press the combtooth pieces 2 at intermediate sections near the base ends from outside toward inside so as to converge them to form a substantially cylindrical column shape. The narrowing section 42 has an inner diameter with which the outer diameter and the inner diameter of the converging section 41 are reduced gradually, the combtooth pieces 2 are pressed at the intermediate sections near the base ends from outside toward inside so as to converge them to form a substantially cylindrical shape, and each of the hemisphere-divided portions 21 can be made to converge to form a substantially hemispherical shape. Note that the converging member 4 may also be integrally formed with the mouth piece used for mounting the nib 1 on the shaft cylinder 19 of the pen shaft 10.

As described above, the base ends of the combtooth pieces 2 are inserted in the fixing sections of the holder member 3 and are arranged along the circumference (of the end surface of the holder member 3). The converging member 4 makes the combtooth pieces 2 converge to form a conical shape. The nib is formed in a conical shape including the writing tip 5 at a tip thereof and ink feed paths 36 defined between adjacent combtooth pieces 2. A single or two or more slits 25 are formed at the tip of each combtooth piece 2 extending from the tip toward the base end. The tips of the combtooth pieces 2 are further separated to form a hemispherical tip and the combtooth pieces are configured to gradually converge toward the tips thereof to form a conical shape. With this configuration, even if the combtooth pieces 2 are small in number, the tips of the combtooth pieces 2 are formed to be hemispherical as much as possible and the entire nib tip can be made to gradually converge to be conical as much as possible.

Figure 3:
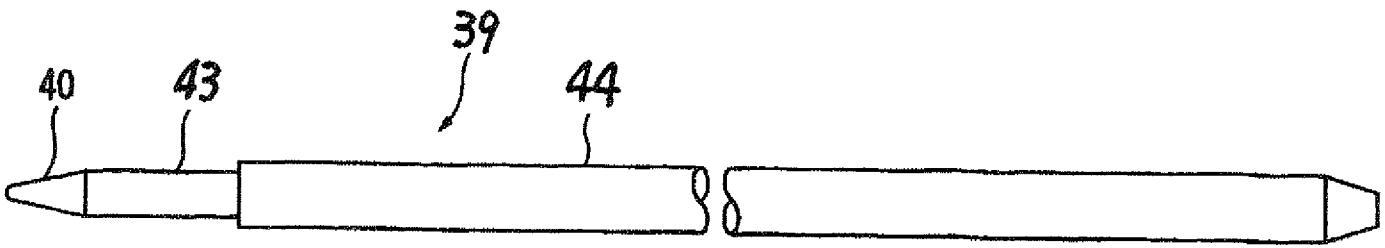
FIG. 3 is a partially cut-away enlarged plan view of an ink feed core according to the first embodiment adapted to the writing instrument.
Figure 4:
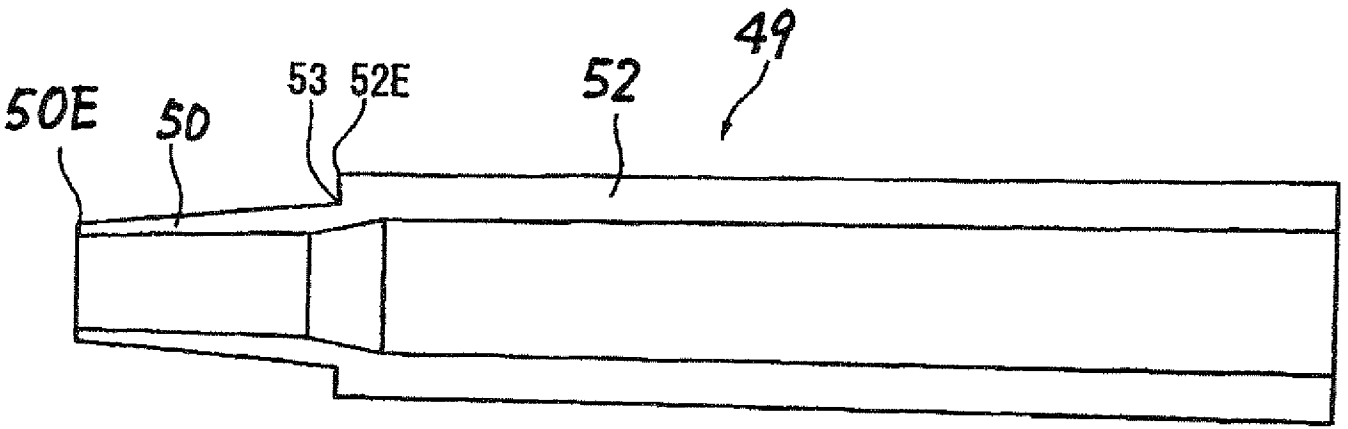
FIG. 4 is an enlarged plan view of a nib cover according to the first embodiment adapted to the writing instrument.

The ink feed core 39 is inserted in a hollow section 30 of the nib 1. The nib 1 is attached to the tip of the pen shaft 10. A nib cover 49 is attached to an outer periphery of the ink feed core 39. The ink feed core 39 herein is a fiber core (i.e., a fiber aggregate) made of, for example, polyester. The ink feed core 39 has a length to be properly disposed inside the nib 1 and the pen shaft 10. As illustrated in FIG. 3, a tip of the ink feed core 39 is formed in a substantially conical shape to be fit in the writing tip 5 of the nib 1 and a tip 30T of the hollow section 30 near the writing tip 5. A rear section of the ink feed core 39 is formed as a round rod. The rear section of the ink feed core 39 is formed as a stepped round rod which includes a front side round rod section 43 and a rear side round rod section 44. The front side round rod section 43 is formed continuously with a substantially conical shaped section 40 at a tip. The rear side round rod section 44 continues to the front side round rod section 43 with an increased outer diameter. A rear end of the rear section is tapered toward a rear end face. The nib cover 49 is mounted on an outer periphery of the ink feed core 39 between the nib 1 and the ink feed core 39. The nib cover 49 is configured to closely adhere at least to an inner periphery of the nib 1 at the tip of the nib 1. As illustrated in FIG. 4, the nib cover 49 is made of a resin material having elasticity. The nib cover 49 has a small-diameter conical trapezoidal section (or a cylindrical column section) 50 and a large-diameter cylindrical column section 52. The small-diameter conical trapezoidal section 50 is able to hold the tip (especially the front side round rod section 43) of the ink feed core 39. The large-diameter cylindrical column section 52 is able to hold an intermediate section (especially a front side of the rear side round rod section 44) of the ink feed core 39. A stepped portion 53 is provided between the small-diameter conical trapezoidal section 50 and the large-diameter cylindrical column section 52. A tip outer peripheral edge 50E of the small-diameter conical trapezoidal section 50 and a front outer peripheral edge 52E of the large-diameter cylindrical column section 52 altogether form an expanding section 55. The expanding section 55 enters a groove (i.e., the ink feed path 36) between an adhesion section 54 and the combtooth pieces 2. The adhesion section 54 is compressed against an inner circumference of the nib 1 and is pressed against inner surfaces of the combtooth pieces 2. The ink feed core 39 is inserted along an axis of the nib cover 49 and the conical tip of the ink feed core 39 protrudes from the nib cover 49. In this manner, the nib cover 49 is mounted on a tip side outer peripheral surface of the ink feed core 39. The ink feed core 39 is inserted in the hollow section 30 from a base end side of the nib 1 to the tip and disposed therein. The tip of the ink feed core 39 is fit in an end of the hollow section 30, i.e., the writing tip 5 and the neighboring tip 30T of the hollow section 30. A conical trapezoidal tip edge section and a cylindrical column-shaped front end edge section of the nib cover 49 are made to closely adhere to the inner circumference of the nib 1. A space defined between the nib 1 and the ink feed core 39 is filled up with the nib cover 49 at the tip side of the nib 1. An outer periphery of ink feed core 39 is surrounded by the nib cover 49 between the nib 1 and the ink feed core 39. In this manner, the base end side of the nib 1 is fixed to the tip of the pen shaft 10 via the mouth piece 20. The ink feed core 39 is connected to the ink reservoir within the pen shaft 10 (i.e., the shaft cylinder 19).

With this configuration, the tips of the combtooth pieces 2 are formed to be hemispherical as much as possible and the entire nib tip can be made to gradually converge to be conical as much as possible. In this manner, a hemispherical writing tip Shaving no bias at tip thereof is formed. Certain ink feed paths 36 are defined between adjacent combtooth pieces 2. With this configuration of the nib 1, when the hemispherical writing tip 5 is pressed against a paper sheet in an inclined manner with respect to the axial center thereof, the hemisphere-divided portions 21 of the combtooth pieces 2 shift and elastically deform with respect to one another so as to increase an outer diameter of the hemispherical tip. When the pressing operation against the paper sheet is released, the tip elastically restores its original hemispherical shape. The thus-configured nib can be used to write in many directions on a paper sheet. The nib can be used to write at any positions and at any angles, even when rotated about the pen shaft 10. The thickness of written lines can be controlled by changing the writing pressure and characters of varying thickness, e.g., brush-characters, can be written in accordance with varying writing pressure. According to the magnitude of the writing pressure, the combtooth pieces 2 deflect and absorb the writing pressure. This cushion effect gives a soft pen touch to fingers and a hand of the writer so that the writer will not easily get tired after long hours of writing. The cushion effect also reduces deformation or wear of the nib when the writing pressure is large and thus improves durability of the writing section. Even if the pen is left unused for many hours or moisture on a surface of the nib tip evaporates leaving the ink to dry and narrow gaps at the nib tip to clog, restarting of a writing action causes the writing tip 5 to move and the hemispherical sections are deformed. The narrow gaps are then also deformed to break a dried ink film or block and thus the ink can be easily taken out again. The slits 25 provided at the tips of the combtooth pieces 2 also cause elastic deformation of the writing tip 5. The slits 25 also have a similar ink-taking effect as that provided by the ink feed paths 36. With this configuration, the above-described writing performance can be improved as much as possible.

In this writing instrument P, the nib cover 49 is mounted on an outer periphery of the ink feed core 39 between the nib 1 and the ink feed core 39. The nib cover 49 is configured to closely adhere at least to an inner periphery of the nib 1 at the tip of the nib 1. A space defined between the nib 1 and the ink feed core 39 is filled up with the nib cover 49. With this configuration, even if the pen is kept with the nib 1 facing downward, the ink is prevented from accumulating in the space between the nib 1 and the ink feed core 39, thereby reliably preventing dropping of ink. Since an outer periphery of the ink feed core 39 is surrounded by the nib cover 49 between the nib 1 and the ink feed core 39, although the nib 1 has a large exposed portion, drying up of the nib 1 (i.e., the ink feed core 39) when the cap is not attached can be prevented reliably.

According to the present embodiment, the nib 1 includes combtooth pieces 2 made of a carbon-resin mixture and a holder member 3 which are separately provided. The combtooth pieces 2 are assembled to the holder member 3 and are made to converge by the converging member 4 to form a conical shape. In the foregoing description, the combtooth pieces 2 are made of a carbon-resin mixture and the holder member 3 and other members may be made of a metallic material, a resin material or a combination thereof, or may be made of the above-described carbon-resin mixture. Preferably, however, in the production of the nib 1 in which the combtooth pieces and the base end are provided separately as described above, the combtooth piece 2 is made of a carbon-resin mixture while the holder member 3 is made of an ordinary plastic material. With this configuration, if the combtooth pieces 2 made of a carbon-resin mixture has high hardness and lacks flexibility during writing, the holder member 3 which is a base portion of the combtooth pieces 2 may be made of a plastic material having hardness lower than that of an ordinary carbon-resin mixture. Since the combtooth pieces 2 are supported by the holder member 3 having high elasticity, a higher degree of elasticity is given to the combtooth pieces 2.

As an exemplary modification of the present embodiment, each of the combtooth pieces may be formed integrally with the base portion. Alternatively, each of the combtooth pieces may be converged (into a conical shape) and thus the converging member may be omitted. In this case, an integral structure of the combtooth pieces and the base portion is made of a carbon-resin mixture. In such a nib structure, a similar operation effect can be obtained by attaching the nib cover to the ink feed core with the ink feed core being inserted in the hollow section of the nib.

As described above, since the nib is made of a carbon-resin mixture obtained by mixing a plastic material with carbon fiber, the writing instrument according to an embodiment of the invention has high wear resistance and the duration of the nib and the writing instrument can be prolonged.

Embodiment 2

Now, a second embodiment of the present invention will be described by referring to the accompanying drawings. In this second embodiment, another nib having a construction in which the combtooth pieces and base portion are provided separately as those described in the first embodiment is explained.

Figure 5:
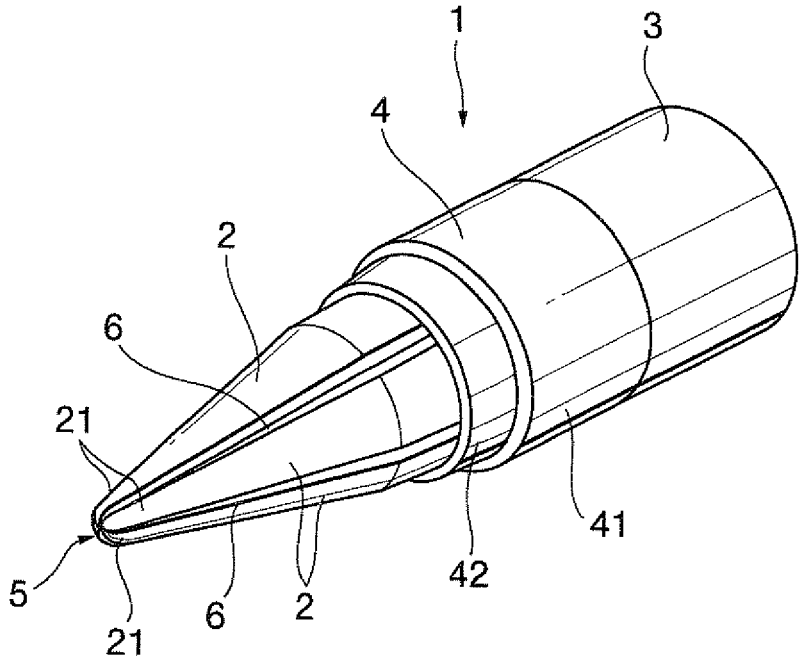
FIG. 5 is a perspective view showing a conical nib according to a second embodiment of the present invention.

FIG. 5 is a perspective view of a conical nib according to the second embodiment of this invention. The construction shown in FIG. 5 is basically the same as that shown in FIG. 2 except that the conical nib shown in FIG. 5 does not have slits 25. In FIG. 5, designated 1 is a conical nib (hereinafter simply referred to as a nib) which has a plurality of combtooth pieces 2, a holder member 3, and a converging member 4. The combtooth pieces 2 are assembled by the holder member 3 and the converging member 4 to form a conical nib that has a writing tip 5 at the front end thereof and ink feeding paths 6 between the combtooth pieces 2. In the present embodiment, the combtooth pieces 2 are made of a carbon-resin mixture obtained by mixing a plastic (i.e., resin) material as a base material with carbon fiber as the combtooth pieces of the first embodiment are. On the other hand, other members including the holder member 3 and the converging member 4 may also be made of the carbon-resin mixture described above, or may be made of a plastic material, a metallic material or a combination thereof. The material used in the combtooth pieces 2, method of forming or roughing the combtooth pieces 2 are the same as that described in the first embodiment.

Figure 6A:
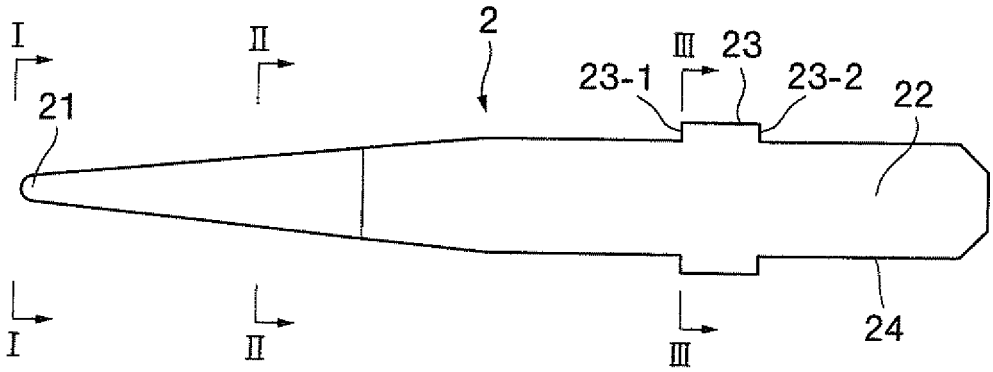
FIG. 6A is a plan view showing one of combtooth pieces of the nib.
Figure 6B:
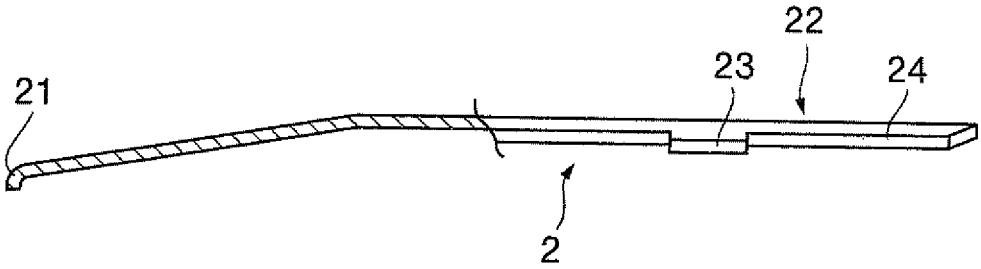
FIG. 6B is a partial cross-sectional side view showing one of combtooth pieces of the nib according to the second embodiment.
Figures 6C, 6D, 6E:
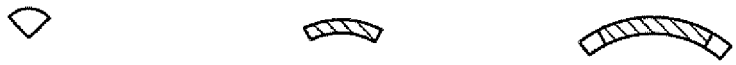
FIG. 6C is a cross-sectional view of each combtooth piece of the nib (taken along the line I-I in FIG. 6A) according to the second embodiment.
FIG. 6D is a cross-sectional view of each combtooth piece of the nib (taken along the line II-II in FIG. 6A) according to the second embodiment.
FIG. 6E is a cross-sectional view of each combtooth piece of the nib (taken along the line III-III in FIG. 6A) according to the second embodiment.
Figure 7:
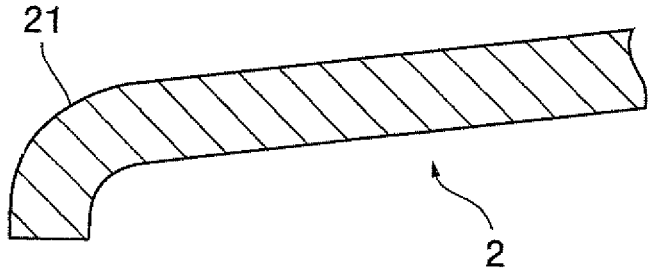
FIG. 7 is an enlarged, partial cross-sectional side view showing an essential part of each combtooth piece of the nib according to the second embodiment.
Figure 10:
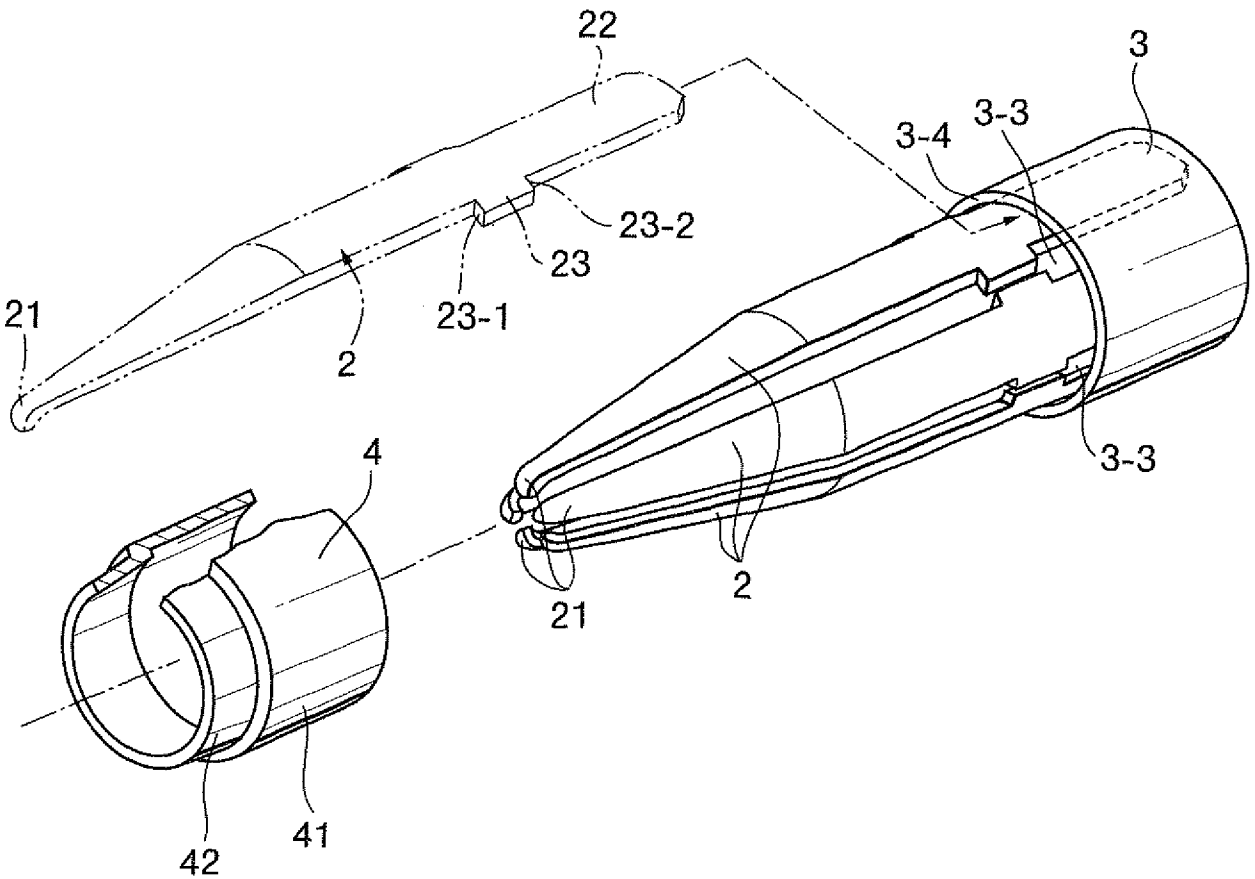
FIG. 10 is a perspective view showing a state of a plurality of combtooth pieces of the nib according to the second embodiment secured to the holder member before a converging member is fitted.

A plurality of combtooth pieces 2 are constructed to be able to converge progressively toward the front end and combine to form a roughly conical nib body with a roughly semispherical front end. Each of the combtooth pieces 2 is generally shaped like a pointed knife, as shown in FIG. 6A, curved widthwise in arc in cross section, as shown in FIG. 6B and FIG. 6C-FIG. 6E, and at its front end formed with a hemisphere-divided portion 21, as shown in FIG. 7. Further, as shown in FIG. 6A, a base end portion 22 of each combtooth piece 2 is adapted to be secured to the holder member 3 and has a flange portion 23 and an expanded width portion 24 wider than the front end side of the combtooth piece 2. The flange portion 23 has a flange portion front side 23-1 and a flange portion rear side 23-2. The flange portion front side 23-1 is used as a push force receiving portion against which an insertion jig is pressed to insert the base end portion 22 into the holder member 3. The flange portion rear side 23-2 abuts against a front end of a fixing portion of the holder member 3 to stop the base end portion 22 at its predetermined position for fixing. At this time, keeping a distance between the flange portion rear side 23-2 and the front end of the combtooth piece 2 to a predetermined length with high precision for all combtooth pieces 2 ensures that, when a predetermined number of combtooth pieces 2 are inserted into the holder member 3 along the circumference thereof as shown in FIG. 10, the front ends of the combtooth pieces 2 conform to the conical geometry of the nib. That is, though separate and independent of each other, the combtooth pieces 2 when assembled are aligned at the front end with high precision to form a smooth writing tip 5. It is preferred that five to eight combtooth pieces 2 be used. These combtooth pieces 2 are made from metal, resin or ceramic or a combination of these.

Figure 8:
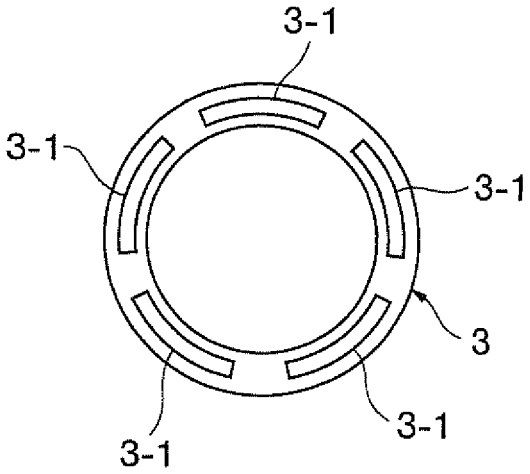
FIG. 8 is an end view of a holder member for the nib according to the second embodiment.

The holder member 3 is generally formed cylindrical as shown in FIG. 8 and, at one end face thereof, has slotlike fixing portions 3-1 into which the base end portions 22 (which are to be fixed) of the combtooth pieces 2 are inserted axially (of the holder member 3). The base end portions 22 of the combtooth pieces 2 are inserted into the fixing portions 3-1 of the holder member 3 so that they are arranged on the circumference (of one end face of the holder member 3). The holder member 3 is formed from metal or resin, or a combination of these.

Figure 9:
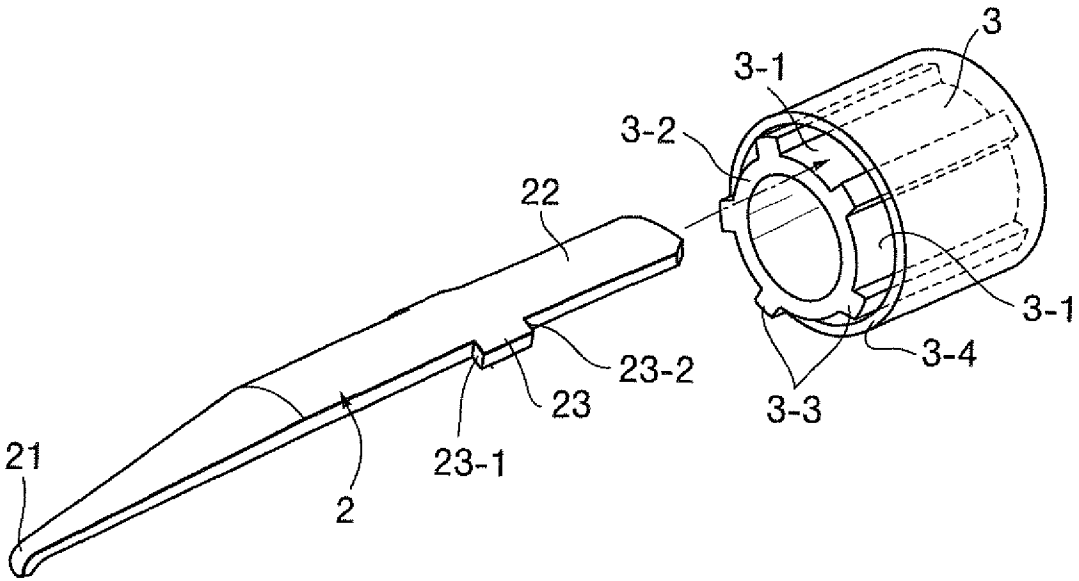
FIG. 9 is a perspective view of a variation of the holder member used on the nib according to the second embodiment.

A variation of the holder member 3 is shown in FIG. 9. This holder member 3 has its cylindrical body divided in two layers. An inner layer cylindrical body 3-2 is made from a resin material by injection molding. This molded member has a plurality of projections 3-3 arranged at equal intervals on its outer circumference that extend over the same length as the molded cylindrical body 3-2. A metal pipe 3-4 as an outer layer is fitted under pressure over an outer circumference of these projections 3-3 to form the holder member 3. Spaces formed between the metal pipe 3-4 and the projections 3-3 constitute the fixing portions 3-1 into which to insert and fix the base end portions 22 of the combtooth pieces 2. This construction enables the combtooth pieces 2 to be arrayed in cylindrical geometry on the outer side of the inner layer cylindrical body 3-2 and on the inner side of the outer layer pipe 3-4. Further, since the outer layer pipe 3-4 is formed of metal, the base end portions 22 of the combtooth pieces 2 can be firmly secured in the spatial fixing portions 3-1, guided by the projections 3-3, without any lateral deviations. The outer layer metal pipe 3-4 can also formed thin to minimize a radial difference between the outer circumferential surface of the outer layer pipe and the arrangement circle of the combtooth pieces 2 while at the same time preventing outward deformations of the outer layer pipe. Thus, the overall construction can be made compact. The cylindrical body 3-2 with the projections 3-3 can also be formed, with improved productivity, by extrusion-molding resin or metal material and cutting to desired lengths.

Figure 11:
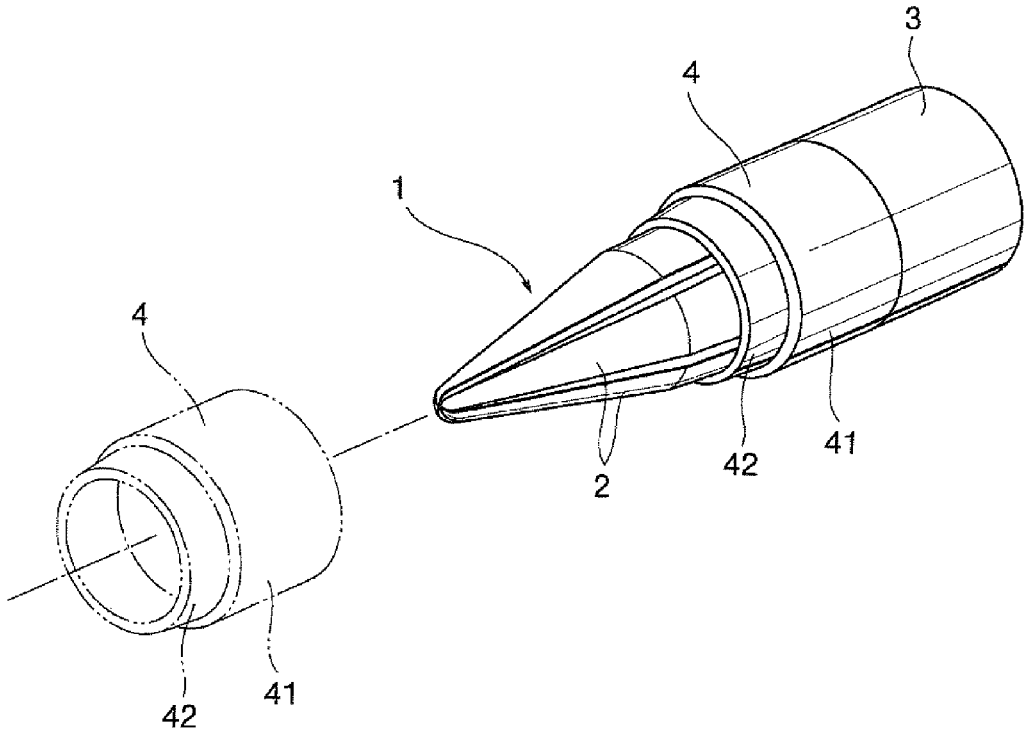
FIG. 11 is a perspective view showing a state of a plurality of combtooth pieces of the nib according to the second embodiment secured to the holder member after a converging member has been fitted.

The converging member 4, as shown in FIG. 5, FIG. 10 and FIG. 11, comprises an almost cylindrical converging portion 41 and a frustoconical throttling portion 42. The converging portion 41 is formed cylindrical so that it can be fitted over the outer circumference of the combtooth pieces 2 arranged along the circumference of the holder member 3. The converging portion 41 has an outer diameter almost equal to that of the holder member 3 and an inner diameter that can press intermediate portions of the combtooth pieces 2 on the base end portion side from the outside toward the inside to converge them into an almost cylindrical shape. The throttling portion 42 has its outer diameter and inner diameter progressively decrease toward the front end so as to press intermediate portions of the combtooth pieces 2 on the front end portion side from the outside toward the inside to converge these combtooth pieces 2 into an almost conical shape and also the hemisphere-divided portions 21 into a virtually hemispherical shape. The converging member 4 is formed from metal or resin, or a combination of these. The converging member 4 may also be formed as a mouth piece to attach the nib 1 to a body of a pen shaft.

Now, a method of manufacturing the nib 1 is briefly explained here. A process of manufacturing the nib 1 comprises a molding process and an assembly process. The molding process molds constitutional parts of the nib 1, i.e., a plurality of combtooth pieces 2, a holder member 3 and a converging member 4. The assembly process consists of a securing step for inserting the base end portions 22 of the combtooth pieces 2 into the fixing portions 3-1 of the holder member 3 to fix them along the circumference of the holder member 3 (see FIG. 10) and a converging step for fitting the converging member 4 over the outer circumference of the combtooth pieces 2 to converge them (FIG. 11). The process of inserting the combtooth pieces 2 into the fixing portions 3-1 of the holder member 3 involves pushing a stepped portion on the front side 23-1 of the flange portion 23 of each combtooth piece 2 until a step portion on the rear side 23-2 of the flange portion 23 abuts against the holding portion (projections 3-3 in the case of FIG. 9).

In the molding process, the nib 1 is constructed of three kinds of constitutional parts. Of these constitutional parts, the combtooth pieces 2 are simplified in shape, which in turn renders dies used for their molding significantly simplified. The combtooth pieces 2 in particular need to have a reliable dimensional precision because they must meet various geometrical requirements. For example, the combtooth pieces 2 generally taper off with their widths progressively decreasing toward the front end and incline inwardly toward the front end, approaching the center axis; the combtooth pieces 2 are also shaped in arc in transverse cross section; and the hemisphere-divided portions 21 at the front end are each formed to ⅕ to ⅛ the size of the hemisphere depending on the number of the combtooth pieces 2 used in the nib. Since the combtooth pieces 2 are fabricated individually, their dimensional accuracies can be checked easily thus preventing faulty parts from being used. Further, outer surface corners of each hemisphere-divided portion 21, i.e., corners formed by an outer surface of the hemisphere-divided portion 21 and its side surfaces, are polished as by blasting, barrel polishing and buffing to round them (or give them an R surface) so that the hemisphere-divided portions 21 do not get caught in a paper surface when they come into contact with it. These combtooth pieces 2 are separate from one another before being assembled and thus their rounding or chamfering operations are easily carried out.

Figure 12:
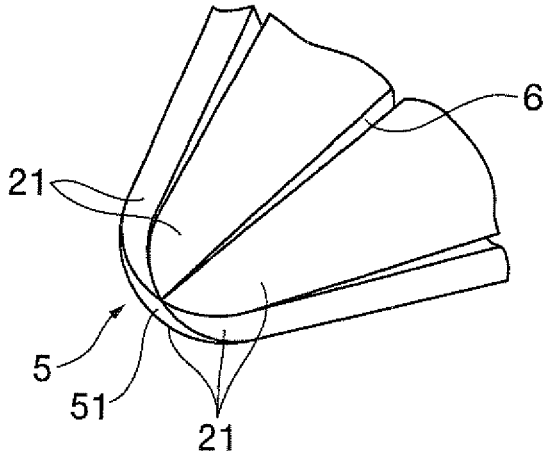
FIG. 12 is a perspective view showing a writing tip of the nib according to the second embodiment.
Figure 13:
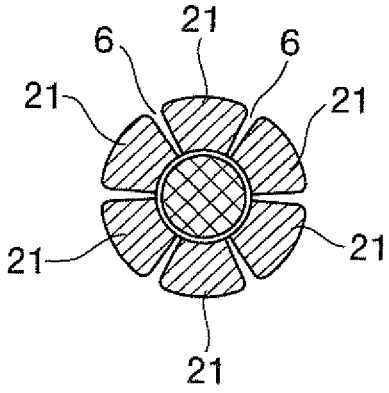
FIG. 13 is a cross-sectional view showing the writing tip of the nib according to the second embodiment.

In the assembly process, since parts are simplified in shape, they can be put on an automated feeding apparatus such as parts feeder for easy assembly. The assembly line can be automated easily because the assembly process only involves simple steps of inserting the combtooth pieces 2 into the fixing portions 3-1 of the holder member 3 and fitting the converging member 4 over the outer circumference of the combtooth pieces 2. In the step of inserting five to eight combtooth pieces 2 into the fixing portions 3-1 of the holder member 3, the combtooth pieces 2 are arranged at equal intervals along a circumference of the center axis, with a slit formed between them. These combtooth pieces 2 are connected to one end face of the holder member 3, with base end side halves of the exposed portions of the combtooth pieces 2 extending linearly from the end face of the holder member 3 and with front end side halves inclining in a direction in which it progressively approaches the center axis toward the front end, like a beak of a bird. Thus, each of the combtooth pieces 2 is shaped in cross section like one of divided, curved segments of a cone and is connected to the holder member 3. In this construction each combtooth piece 2 is supported like a cantilevered triangular plate with one end fixed in the fixing portion 3-1 of the holder member 3, i.e, it has the same structure as a cantilevered beam with one end fixed. Following the assembly of the combtooth pieces 2 and the holder member 3, the next operation of fitting the converging member 4 over the outer circumference of the combtooth pieces 2 is performed. In this case, the converging member 4 is sleeved until a circumferential end face of the converging portion 41 abuts against a circumferential end face of the holder member 3. The converging portion 41 of the converging member 4 presses the base end side portions of five to eight combtooth pieces 2 from the outer circumference toward the center axis to converge the intermediate portions of the combtooth pieces on the base end side inwardly into an almost cylindrical shape. At the same time, the throttling portion 42 of the converging member 4 presses the intermediate portions of these combtooth pieces 2 on the front end side from the outer circumference toward the center axis to converge them inwardly, causing the intermediate to front end portions of the combtooth pieces 2 to assume a conical geometry, with the hemisphere-divided portions 21 at the front ends of the combtooth pieces 2 combined to form a hemisphere. A uniform pressure of the converging member 4 ensures that the base end side portions of five to eight combtooth pieces 2 converge into a cylindrical shape without deformations and that the front end side portions converge into a conical shape without deformation that progressively decreases in diameter. At the same time, the hemisphere-divided portions 21 at the front ends are also brought together through elastic engagement between the combtooth pieces 2 to forma smooth hemispherical writing tip 5 with no undulations, as shown in FIG. 12 and FIG. 13. The writing tip 5, made up of a plurality of front ends of the combtooth pieces 2 combined, looks like petals in cross section. A periphery of the tip portion 51 constitutes a writing portion that is placed in contact with a paper surface for writing. At interface portions on both sides of each combtooth piece 2, i.e., between the adjoining combtooth pieces 2, are formed ink feeding paths 6 shaped like capillary slits.

Figure 14:
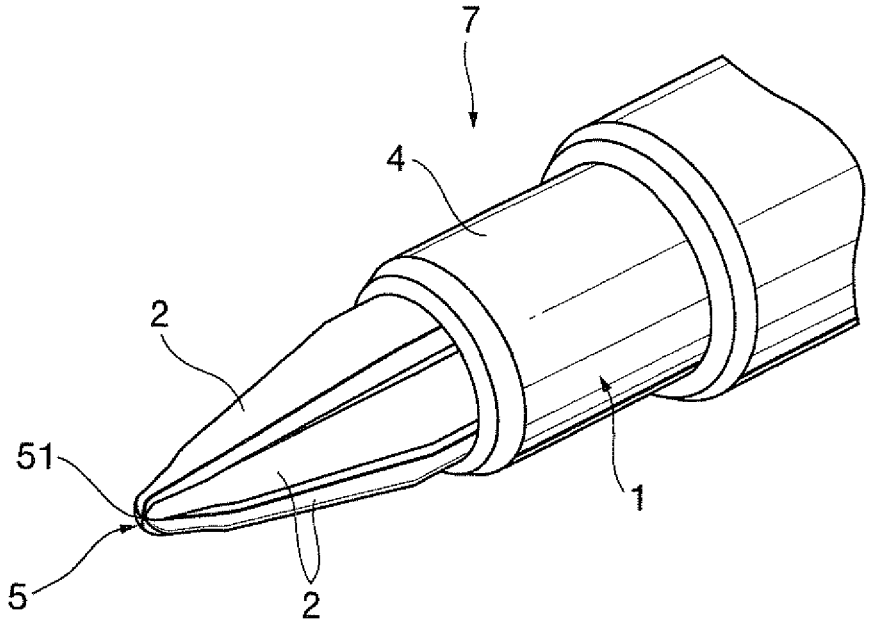
FIG. 14 is a perspective view showing a part of a writing instrument using the nib according to the second embodiment.

Next, a writing action of a writing instrument using this nib 1 will be explained with reference to FIG. 14 through FIG. 19. FIG. 14 shows a writing instrument 7 using this nib 1. In this writing instrument 7, the combtooth pieces 2 of the nib 1 constitute divided pieces that together form a conical shape and are independent of each other at the front ends. That is, each of the combtooth pieces 2 has a hemisphere-divided molded portion at the front end, one of divided parts of a hemisphere portion at the front end of the nib; and each combtooth piece 2 is shaped in cross section like one of divided, curved segments of a cone over a length up to where it is connected to and secured in the cylindrical holder member 3 (FIG. 5). Thus, each combtooth piece 2 is supported like a cantilevered triangular plate with one end fixed in the holder member 3, i.e., it has the same structure as a cantilevered beam with one end fixed. Therefore, when, during the use of the writing instrument 7, a writing pressure acts on the nib 1 applying an upward force (deflecting force) to the front end of the combtooth piece 2, the combtooth piece 2 is deflected with a portion fixed by the converging member 4 acting as a fulcrum. When released from this upward pressing force, the combtooth piece 2 restores its original shape.

Figure 15:
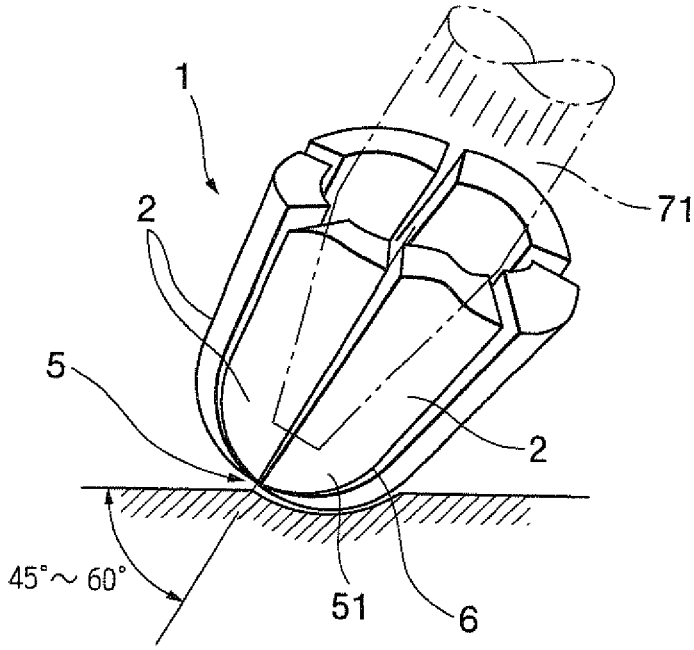
FIG. 15 is a partial perspective view showing the writing tip of the nib according to the second embodiment pressed against a paper surface.

When viewed three-dimensionally, the tip portion 51 of the nib 1, that forms the hemispherical writing tip 5 made up of the front end portions of the combtooth pieces 2 converged into a conical shape, is as shown in FIG. 15, FIG. 16A or FIG. 18A. FIG. 15 is a perspective view showing only a conical portion of the nib comprised of six combtooth pieces 2, with the tip portion 51 in contact with a paper surface. In FIG. 15 reference number 71 represents an ink feeding core.

As shown in FIG. 15, when, during the use of the writing instrument 7, the nib 1 is placed in contact with paper at an angle in a practical range of between about 45° and 60°, ink that is introduced to joint gaps in the tip portion 51 of the nib 1, i.e., to the inside of the front end portion of the ink feeding paths 6, is drawn out by a capillary attraction that develops at a contact area between the paper surface and the tip portion 51, the ink being distributed onto the paper surface to draw a line. Elastic deformations (or elastic deforming actions) of the hemispherical writing tip 5 caused by the writing pressure are shown in FIG. 16 to FIG. 19.

Figure 16:
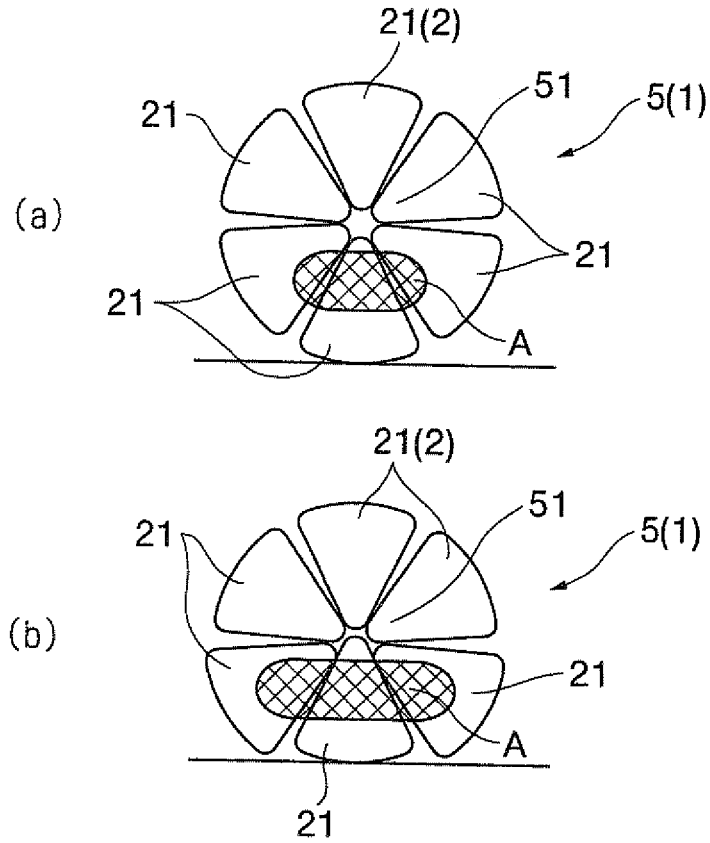
FIG. 16 is a front end view showing how the writing tip behaves in the second embodiment.
Figure 17:
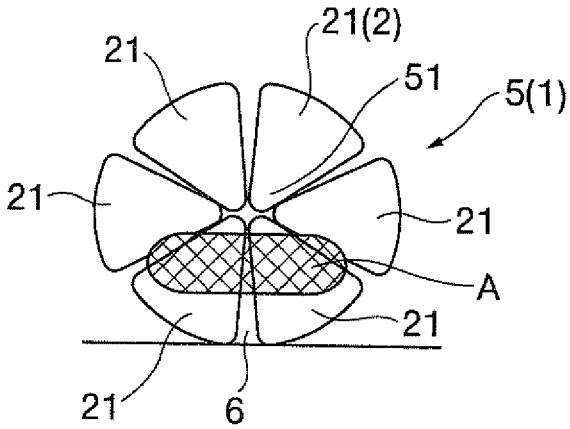
FIG. 17 is a front end view showing how the writing tip behaves in the second embodiment.
Figure 18:
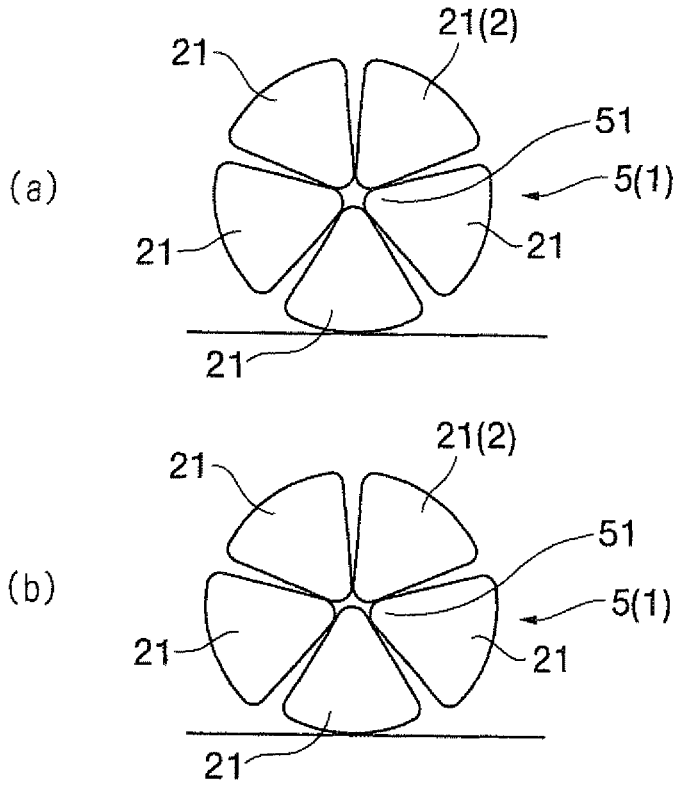
FIG. 18 is a front end view showing how the writing tip made up of a different number of combtooth pieces behaves in the second embodiment.
Figure 19:
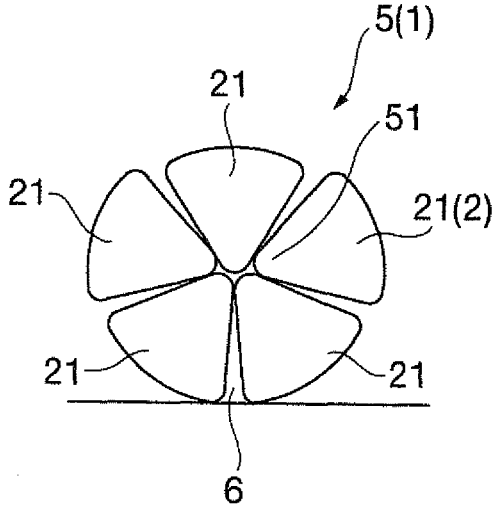
FIG. 19 is a front end view showing how the writing tip made up of the different number of combtooth pieces behaves in the second embodiment.

FIG. 16 and FIG. 17 are end views showing changes in shape, during a writing operation, of the writing tip 5 of a nib 1 whose conical portion is made up of six combtooth pieces 2. FIG. 18 and FIG. 19 are end views showing changes in shape of the writing tip 5 of a nib 1 during the writing operation when the conical portion of the nib is made up of five combtooth pieces 2. FIG. 16A illustrates a state of the tip portion 51 when the pen is held close to a paper surface so that at the tip of the nib 1 one of the combtooth pieces 2 assumes a bottom position directly below the center axis of the nib and the tip portion 51 is still out of contact with or lightly in contact with the paper surface and is applied with no writing pressure. In this state, because none of the combtooth pieces 2 is applied a deflecting force, they are inelastic contact with one another. Next, when a writer applies a writing force to the nib, the tip portion 51 as the front ends of the combtooth pieces 2 is deflected by the writing pressure and moves up, with the fixed portions of the combtooth pieces 2 in the converging member 4 acting as a fulcrum. At this time, a stiffness of the material of the combtooth pieces 2 produces a resisting force which, under a normal writing pressure, restricts a distance the front end moves or a displacement of the tip portion 51 to a predetermined magnitude, for example 0.1-0.5 mm. Behaviors of the individual front ends of the combtooth pieces 2 making up the hemispherical tip portion 51 as seen from the front are as follows. Of a plurality of combtooth pieces 2 making up the tip portion 51, a combtooth piece 2 situated at the bottom of the nib is pushed up at its front end, forcing an opposing top combtooth piece 2 upward and pushing away sideways combtooth pieces 2 situated on both sides, as shown in FIG. 16B. As a result, the hemispherical tip portion 51 deforms and the writing tip 5 as a whole shifts.

When viewed as a whole, the outer diameter of the hemispherical portion and therefore the paper contact area increase. In FIG. 16B a shaded area A in which the nib contacts the paper surface expands. The degree of this expansion increases with a pressure with which the nib 1 is pressed against the paper surface, or the writing pressure. The thickness of a written line depends on the outer diameter of the tip portion 51. Since the line thickness increases as the hemispherical shape expands, lines can be drawn thick or thin depending on the magnitude of the writing pressure. Further, according to the magnitude of the writing pressure, the combtooth pieces 2 as a whole deflect, producing a cushion effect whereby the writing pressure, if large, can be absorbed by the entire combtooth pieces 2.

Unlike FIG. 16A and 14B, FIG. 17 shows a deformed state of the tip portion 51 when the pen is held close to a paper surface so that at the tip of the nib 1 one of ink feeding paths 6 between two combtooth pieces 2 comes directly below the center axis of the nib and the tip portion 51 is applied a writing pressure. Behaviors of the individual front ends of the combtooth pieces 2 making up the hemispherical writing tip 5 as seen from the front are as follows. Of a plurality of combtooth pieces 2 making up the tip portion 51, two combtooth pieces 2 situated at the bottom of the nib are pushed up at their front ends by the writing pressure, forcing away sideways adjoining combtooth pieces 2, thereby elastically deforming the hemispherical tip portion 51. Other actions or behaviors are the same as those explained in conjunction with FIG. 16A and FIG. 16B. In other writing states than those shown in FIG. 16A, FIG. 16B and FIG. 17, that is, whatever rotating angle position about the pen axis the nib 1 takes, when the tip portion 51 of the nib 1 engages with a paper surface at an angle, the writing tip 5 slightly expands due to elastic deformation and performs the similar actions or behaviors to those described above.

In the case of FIG. 18, deformations similar to those described in conjunction with FIG. 16 also occur during the writing operation. FIG. 18A shows a state of the tip portion 51 when the pen is held close to a paper surface so that at the tip of the nib 1 one of the combtooth pieces 2 assumes a bottom position directly below the center axis of the nib and the tip portion 51 is still out of contact with or lightly in contact with the paper surface and is applied with no writing pressure. In this case, since none of the combtooth pieces 2 is applied a deflecting force, they are in elastic contact with one another. Next, when a writer applies a writing force to the nib, the tip portion 51 as the front ends of the combtooth pieces 2 secured in the holder member 3 is deflected by the writing pressure and moves up. The displacement of the tip portion 51, when subjected to a normal writing pressure, is within a range of 0.1 to 0.5 mm as in the case of FIG. 16. Behaviors of the individual front ends of the combtooth pieces 2 making up the hemispherical tip portion 51 as seen from the front are as follows. The conical portion of the nib 1 in this case is comprised of five combtooth pieces 2. Of these combtooth pieces 2 making up the tip portion 51, a combtooth piece 2 situated at the bottom of the nib is pushed up at its front end, forcing away sideways combtooth pieces 2 situated on both sides, as shown in FIG. 18B. As a result, the hemispherical tip portion 51 deforms.

FIG. 19, unlike FIG. 18A and FIG. 18B, shows a deformed state of the writing tip 5 when the pen is held close to a paper surface so that at the tip of the nib 1 one of ink feeding paths 6 between two combtooth pieces 2 comes directly below the center axis of the nib and the tip portion 51 is applied a writing pressure. Behaviors of the individual front ends of the combtooth pieces 2 making up the hemispherical tip portion 51 as seen from the front are as follows. Of a plurality of combtooth pieces 2 making up the tip portion 51, two combtooth pieces 2 situated at the bottom of the nib are pushed up at their front ends by the writing pressure, forcing up an opposing top combtooth piece 2 through a coordinated action of the bottom combtooth pieces 2 and pushing away sideways combtooth pieces 2 situated on both sides. As a result, the hemispherical tip portion 51 is deformed. Other actions or behaviors are the same as those described earlier. Although FIG. 19 does not show an area A, shown shaded in FIG. 17, in which the nib contacts the paper surface, the similar contact area A develops also in the case of FIG. 19 during the writing operation.

In the second embodiment described above, since the nib 1 is formed by assembling a plurality of separate combtooth pieces 2 using the holder member 3 and the converging member 4, these components can be made simple in shape. This in turn minimizes variations in dimensional and positional accuracies during the manufacturing process, assuring a high-yield mass production of such nibs. With this construction it is also possible to chamfer or round the outer surface corners of the tip easily and supply inexpensive products in large quantities.

Further, five to eight combtooth pieces 2 are secured at one end to the holder member 3 and have the converging member 4 sleeved thereover. In this construction, the uniform pressure of the converging member 4 ensures that the five to eight combtooth pieces 2 are formed into a conical shape without deformations; at the tip of the nib is formed the hemispherical writing tip 5 which has the combtooth pieces correctly aligned; the ink feeding paths 6 are formed between the combtooth pieces 2. With this construction, when the hemispherical writing tip 5 is pressed against a paper surface with its center axis at an angle to the paper, the hemisphere-divided portions 21 at the front ends of the combtooth pieces 2 shift relative to each other, resulting in an elastic deformation of the writing tip 5, which in turn increases an outer diameter of the hemispherical portion at the tip; and when the action of pressing the hemispherical writing tip 5 against the paper surface is eliminated, the tip portion returns to its original hemispheric shape by elasticity. The above-described behavior of the nib, therefore, allows the nib to write on a paper surface in any direction and, even if the nib is rotated about the pen axis, to write at any position on the hemispherical tip portion and at any angle. Further, by adjusting a writing pressure, it is possible to change the thickness of a line, allowing a writer to write a variety of modes of letters with a changing line width, such as those produced by a writing brush. According to the magnitude of the writing pressure, the combtooth pieces 2 deflect to absorb the writing pressure. This cushion effect gives the writer a soft writing feel, so that the writer can continue writing for many hours without fatigue. The cushion effect also reduces the deformation and wear of the tip of the nib when subjected to a high writing pressure, thus improving the durability of the writing tip. Further, if a pen is left unused for many hours or if water evaporates from the surface of the tip of the nib, drying ink and clogging fine ink feeding gaps at the tip, the restarting of writing causes the hemispherical writing tip 5 to deform and fine gaps to move, breaking a dry ink film or lump and allowing ink to be drawn out.

If, in the second embodiment, the number of divisions of hemispherical writing tip 5 is reduced as by using four or less combtooth pieces 2 instead of five to eight combtooth pieces 2 in constructing the conical portion of the nib, the intervals of the interfacing portions formed between the combtooth pieces 2 and constituting the ink feeding paths 6 become large when compared with the outer diameter of the writing tip. When the nib 1 is placed in contact with a paper surface, a distance between the paper surface and the ink feeding paths may increase depending on the angle of the nib with respect to the paper surface. In that case, since the portion that draws out ink by the capillary attraction is not close enough to the paper surface, a smooth feeding of ink may be interrupted. Therefore, the angle of the nib with respect to the paper surface needs to be restricted to some extent. One of the features of the nib according to this invention is an ability to write smoothly and freely in any direction with respect to the center axis and in as wide a range of writing angle as possible, for example, between 90° and 45°. However, by limiting this writing angle to some extent, it is possible to reduce the number of divisions of the conical portion to four or three and still produce the similar effects and advantages, as long as the similar construction is employed in which the hemisphere-divided portions at the tip shift relative to each other and in which the writing tip slightly expands according to the magnitude of the writing pressure applied.

Further, also in this second embodiment, it is preferable that the combtooth piece 2 is made of a carbon-resin mixture while the holder member 3 is made of an ordinary plastic material. With this configuration, if the combtooth pieces 2 made of a carbon-resin mixture has high hardness and lacks flexibility during writing, the holder member 3 which is a base portion of the combtooth pieces 2 may be made of a plastic material having hardness lower than that of an ordinary carbon-resin mixture. Since the combtooth pieces 2 are supported by the holder member 3 having high elasticity, a higher degree of elasticity is given to the combtooth pieces 2.

As described above, since the nib of the second embodiment also is made of a carbon-resin mixture obtained by mixing a plastic material with carbon fiber, the writing instrument according to the present embodiment of the invention has high wear resistance and the duration of the nib and the writing instrument can be prolonged.

The invention has been described with reference to the preferred embodiments illustrated in the drawings. However, it will be apparent to those skilled in the art that various changes and modifications can be made without departing from the spirit and scope of the invention. The invention also includes those modifications.

What is claimed is:

1. A conical nib that is secured to a tip of a pen shaft containing an ink reservoir and is connected to the ink reservoir via an ink feed core having capillary action, the nib comprising: a cylindrical holder member; and a plurality of combtooth pieces provided at an end of the holder member, each of the combtooth pieces having a substantially hemispherical tip, the combtooth pieces being configured to gradually converge toward the tips thereof to form a substantially conical shape and the nib being formed in a conical shape including a writing tip at a tip thereof and ink feed paths defined between adjacent combtooth pieces, wherein the nib is made of a carbon-resin mixture obtained by mixing a plastic material with carbon fiber.

2. The conical nib according to claim 1, wherein a mixing ratio of the plastic material to the carbon fiber in the carbon-resin mixture used for the nib is 95 to 70% by weight to 5 to 50% by weight.

3. The conical nib according to claim 1, wherein an inner surface of the nib is roughened.

4. A writing instrument comprising: a pen shaft which has an ink reservoir containing ink; and a nib which is fixed at a tip of the pen shaft and is connected to the ink reservoir via an ink feed core which has capillary action, in which the nib includes a cylindrical holder member and a plurality of combtooth pieces provided at an end of the holder member, each of the combtooth pieces having a substantially hemispherical tip and the combtooth pieces being configured to gradually converge toward the tips thereof to form a substantially conical shape, and the nib is formed in a conical shape including a writing tip at a tip thereof and ink feed paths defined between adjacent combtooth pieces, wherein the nib is made of a carbon resin mixture obtained by mixing a plastic material with carbon fiber.

5. The conical nib according to claim 2, wherein an inner surface of the nib is roughened.

* * * * *